United States Patent [19]

Wirth et al.

[11] Patent Number: 4,632,580

[45] Date of Patent: Dec. 30, 1986

[54] DOT MATRIX PRINT HEAD DAMPENING MECHANISM

[75] Inventors: Robert L. Wirth; Kenneth W. Hanna, both of Ithaca; Hillis L. Wilson, Groton, all of N.Y.

[73] Assignee: NCR Corporation, Dayton, Ohio

[21] Appl. No.: 715,868

[22] Filed: Mar. 25, 1985

[51] Int. Cl.[4] ..... B41J 3/12

[52] U.S. Cl. ..... 400/124; 101/93.05

[58] Field of Search ..... 400/124; 101/93.05; 335/271, 277

[56] References Cited

U.S. PATENT DOCUMENTS

| | | | |
|---|---|---|---|
| 3,675,172 | 7/1972 | Petusky | 335/257 |
| 3,787,791 | 1/1974 | Borger et al. | 335/274 |
| 3,929,214 | 12/1975 | Hebert | 400/124 |
| 3,994,381 | 11/1976 | Hebert | 400/124 |
| 4,051,941 | 10/1977 | Hebert | 400/124 |
| 4,081,067 | 3/1978 | Schrag et al. | 400/124 |
| 4,140,406 | 2/1979 | Wolf et al. | 400/124 |
| 4,200,401 | 4/1980 | Roy et al. | 400/124 |
| 4,209,260 | 6/1980 | Jung | 400/53 |
| 4,230,412 | 10/1980 | Hebert | 400/124 |
| 4,272,748 | 6/1981 | Fugate et al. | 335/271 |
| 4,320,981 | 3/1982 | Harrison et al. | 400/124 |
| 4,367,962 | 1/1983 | Gaboardi | 101/93.05 X |
| 4,375,338 | 3/1983 | Mitsuishi | 400/124 |
| 4,382,701 | 5/1983 | Davenport | 400/124 |
| 4,401,392 | 8/1983 | Blomquist et al. | 400/124 |
| 4,407,591 | 10/1983 | Adamoli et al. | 400/124 |
| 4,423,969 | 1/1984 | Kobryn | 101/93.05 X |
| 4,478,528 | 10/1984 | Hebert | 400/124 |
| 4,502,799 | 3/1985 | Weeks | 400/124 |

*Primary Examiner*—Paul T. Sewell

*Attorney, Agent, or Firm*—Wilbert Hawk, Jr.; Albert L. Sessler, Jr.; George J. Muckenthaler

[57] ABSTRACT

A mechanical damper system for use in a multiple wire, dot matrix print head to dampen the motion of each print wire actuator when such actuator returns from the printing position to the non-printing or home position. A single injection-molded plastic piece includes a plurality of plunger backstops arranged in a circle and spring-hinged for impact against a rubber damper by the respective print wire actuators.

19 Claims, 6 Drawing Figures

DOT MATRIX PRINT HEAD DAMPENING MECHANISM

BACKGROUND OF THE INVENTION

In the field of printing, the most common type printer has been the printer which impacts against record media that is caused to be moved past a printing line or line of printing. As is well-known, the impact printing operation depends upon the movement of impact members, such as print hammers or wires or the like, which are typically moved by means of an electromechanical system and which system enables precise control of the impact members.

In the field of dot matrix printers, it has been quite common to provide a print head which has included therein a plurality of print wire actuators or solenoids arranged or grouped in a manner to drive the respective print wires a precise distance from a rest or non-printing position to an impact or printing position. The print wires are generally either secured to or engaged by the solenoid plunger or armature which is caused to be moved such precise distance when the solenoid coil is energized and wherein the plunger normally operates against the action of a return spring.

It has also been quite common to provide an arrangement or grouping of such solenoids in a circular configuration to take advantage of reduced space available in the manner of locating the print wires in that area from the solenoid to the front tip of the print head adjacent the record media. In this respect, the actuating ends of the print wires are spaced in accordance with the circular arrangement and the operating or working ends of the print wires are closely spaced in vertically-aligned manner adjacent the record media. The availability of narrow or compact actuators permits a narrower print head to be used and thereby reduces the width of the printer because of the reduced clearance at the ends of the print line. The print head can also be made shorter because the narrow actuators can be placed in side-by-side manner closer to the record media for a given amount of wire curvature.

In the wire matrix printer, the print head structure may be a multiple-element type with the wire elements aligned in a vertical line and supported on a print head carriage which is caused to be moved or driven in a horizontal direction for printing in line manner, while the drive elements or transducers may be positioned in a circular configuration with the respective wires leading to the front tip of the print head.

Alternatively, the printer structure may include a plurality of equally-spaced, horizontally-aligned single-element print heads which are caused to be moved in back-and-forth manner to print successive lines of dots in making up the lines of characters. In this latter arrangement, the drive elements or transducers are individually supported along a line of printing. These single wire actuators or solenoids are generally tubular or cylindrically shaped and include a shell which encloses a coil, an armature and a resilient member arranged in manner and form wherein the actuator is operable to cause the print wire to be axially moved a small precise distance in dot matrix printing.

In the concept of dot matrix printing, it is generally desired to place the print element actuators in a position to allow characters to be printed in serial manner and this placement requires that the print wire or like print element actuators be very closely spaced with respect to each other. Since the print actuators are generally much larger in size then the diameter of the printed dot, a relatively long wire or like element must be provided to bring the desired print activity from its source, such as moving armature or plunger or the like, to a vertical closely-spaced column arranged in a pattern such that the column of closely-spaced, tangentially coincident or overlapping dots will be produced on the record media if all actuators are fired or actuated at one time.

Representative documentation in the field of wire matrix print heads includes U.S. Pat. No. 3,675,172, issued to N. J. Petusky on July 4, 1972, which discloses a damping system having an energy transfer element between two restraining walls, one of which is of energy absorptive material, the transfer element being engageable by an actuator element.

U.S. Pat. No. 3,787,791, issued to J. H. Borger et al. on Jan. 22, 1974, discloses a solenoid having a plunger engageable with a flat spring which fits in recesses of a plastic spring seat.

U.S. Pat. No. 3,929,214, issued to D. G. Hebert on Dec. 30, 1975, discloses a print head having a unitary connector with an O-ring inserted in a groove and acting as a shock absorber to provide a reference surface for the stylus striking ends of the armature.

U.S. Pat. No. 3,994,381, issued to D. G. Hebert on Nov. 30, 1976, discloses a print head having an armature retainer loaded by a spring and including a backstop or bumper cushion which cushions the return shock of the armature.

U.S. Pat. No. 4,051,941, issued to D. G. Hebert on Oct. 4, 1977, discloses a print head having an armature retainer with a shock absorbing O-ring member engageable by ends of the armatures. The retainer includes a central disk portion secured with a screw.

U.S. Pat. No. 4,081,067, issued to R. L. Schrag et al. on Mar. 28, 1978, discloses a print head having a centrally disposed dampening member and a unitary connector with a groove carrying an O-ring to act as a shock absorber for the armatures. A screw and a washer secure the unitary connector to the frame.

U.S. Pat. No. 4,140,406, issued to P. H. Wolf et al. on Feb. 20, 1979, discloses a print head having an armature retainer secured by a screw and carrying adjusting elements engageable with a rubber damper against ends of the armatures.

U.S. Pat. No. 4,200,401, issued to K. L. Roy et al. on Apr. 29, 1980, discloses a solenoid having an impact disk against a block or pad of energy absorbing rubber or like material to take the impact of the print wire.

U.S. Pat. No. 4,209,260, issued to F. Jung on June 24, 1980, discloses a print head having a back plate and a central member with adjustable means for the armatures.

U.S. Pat. No. 4,230,412, issued to D. G. Hebert on Oct. 28, 1980, discloses a cover plate having an elongated adjustment and abutment hub member secured by a screw, and an O-ring member against one end of the hub member and engageable by ends of the armatures.

U.S. Pat. No. 4,272,748, issued to P. E. Fugate et al. on June 9, 1981, discloses a solenoid having a rebound and energy absorbing arrangement which employs a block of energy-absorbing dead elastomeric material held in a partially compressed state by an impact plate.

U.S. Pat. No. 4,320,981, issued to M. Harrison et al. on Mar. 23, 1982, discloses a print head having a backplate with adjusting screws and shock absorbing material between the armatures and the backplate.

U.S. Pat. No. 4,382,701, issued to K. B. Davenport on May 10, 1983, discloses an armature support frame carrying resilient plugs forming backup dampers with adjustment screws.

U.S. Pat. No. 4,401,392, issued to J. E. Blomquist et al. on Aug. 30, 1983, discloses a print head having an armature retaining screw and a resilient backstop against which the ends of the armatures engage.

U.S. Pat. No. 4,407,591, issued to C. Adamoli et al. on Oct. 4, 1983, discloses a ballistic wire matrix print head having a single rear plastic support connected by means of a capping nut, along with a first ring of resilient material on the support to keep the armatures biased against pole surfaces, and a second ring of resilient material on the support engaging with inner ends of the armatures.

And, U.S. Pat. No. 4,478,528, issued to D. G. Hebert on Oct. 23, 1984, discloses an armature retaining cover plate with resilient cushion means and/or biasing spring means to dampen the return movement of the armature members.

SUMMARY OF THE INVENTION

The present invention relates generally to impact printing devices for dot matrix printing wherein at least one print wire or needle is caused to be propelled against a printing medium or like record media by an associated clapper-type, solenoid-actuated, print wire driver for printing dot matrix characters in accordance with external control signals which cause energization of the driver coil and movement of the print wire for enabling printing of the characters. More particularly, the present invention relates to an improved wire matrix print head having a plurality of actuators or drivers positioned for respective print wires and wherein each actuator coil is energized to cause an associated armature or clapper which is engaged with a print wire to propel such print wire or needle a precise distance to mark or print a dot on the record media.

The print wire actuators are arranged in a circular configuration adjacent the print head housing and each of the actuators is associated with the clapper-type armature, in turn engageable with the actuating end of the print wire. The several print wires are arranged to conform with the circular configuration of the print wire actuators at the actuating ends of the print wires and are guided along separate paths to the nose portion of the print head wherein the operating ends of the wires are disposed in a closely-spaced single column so as to effect dot matrix printing.

A unitary member is positioned centrally of the print wire actuators at one end of the print head and is used to position the armatures in relation to the actuators or drivers of the print head. The unitary member is generally cylindrically-shaped to fit in spaces or openings between the inner core poles of the print head actuators and includes a plurality of fingers spaced to locate the armatures in angular relationship in the circular configuration.

Additionally, an end surface of the unitary member is positioned to be engageable by an end plate of the print head and the plurality of fingers are formed to be engageable with an annular portion of the nose of the print head for spacing the parts. The single member thus serves the combined functions of spacing at least two parts of the print head and for providing positioning means for the armatures thereof.

A fastening member is positioned at one end of the print head device and is used to secure the actuator coil assembly to the main body or housing of the print head. The fastening member is cylindrically-shaped to fit substantially inside the unitary member and to fit in apertures or openings and to protrude through several parts of the print head. The fastening member includes a lip or flange portion at one end thereof and a plurality of fingers at the other end to secure the parts together.

Additionally, one end of the fastening member defines a hollow portion in which is located a damper, a plunger backstop, and a plunger stop all of which are secured to the fastening member and positioned to be engageable by one end of each armature to serve as a non-printing or home position seat or backstop for dampening the return motion of the print wires. The fastening member thus serves the combined functions of fastening several parts of the print head and providing a dampening seat for the armatures thereof.

In view of the above discussion, the principal object of the present invention is to provide means for simplifying the assembly of a wire matrix print head.

Another object of the present invention is to provide a single member for securing together several parts of a print head.

An additional object of the present invention is to provide a single member with dampening means for use as a backstop for the actuating elements of a print head.

A further object of the present invention is to provide a single member, both for securing the print head in assembled condition and for serving as a home position backstop for the print head armatures.

Still another object of the present invention is to provide an armature backstop assembly having individual elements for the print wire armatures.

Additional advantages and features of the present invention will become apparent and fully understood from a reading of the following description taken together with the annexed drawing.

DESCRIPTION OF THE PREFERRED EMBODIMENT

Figure 1:
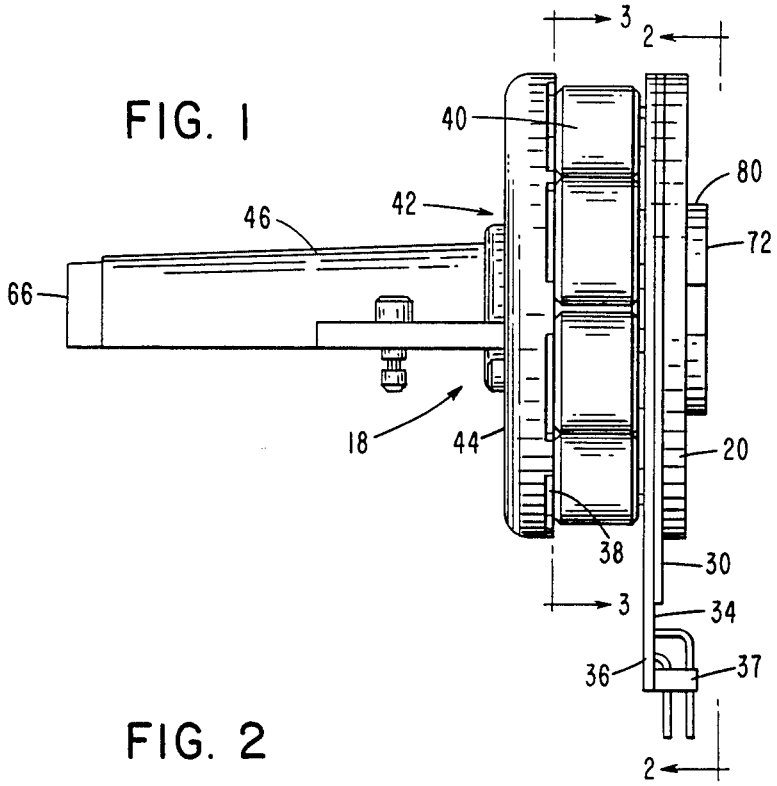
FIG. 1 is a side elevational view of a print head incorporating the subject matter of the present invention.

FIG. 1 is a side elevational view which illustrates certain parts of a wire matrix-type print head 18 and including an aluminum backplate 20 of circular shape with an aperture 22 (FIG. 2) in the center thereof. A plurality of magnetic core members 23 having outer pole pieces 24 and inner pole pieces 26 (FIGS. 2 and 3) are inserted through respective windows 28 in the backplate 20 and are securely attached so as to be flush with the outer surface of the backplate, with the pole pieces then extending through like windows 28 in an insulating spacer 30 of generally circular shape and made of paper or like material. The core member pole pieces 24 and 26 further extend through windows 32 (FIG. 2) of a printed circuit board 34, also generally circular shaped, but which board includes a lower portion 36 containing socket means 37 for enabling the gathering of and for connecting the individual printed circuits of the circuit board to external wiring. The next element in the arrangement of the print head 18 is a residual spacer 38 (FIG. 1) of circular shape and sized of smaller diameter than the above-mentioned parts. The function of the spacer 38 is to minimize the effects of residual magnetism between the pole pieces 24 and 26 and an operating member (later described) actuated by the magnet associated with the core member 23. The printed circuit board 34 both supports and connects a plurality of actuating coils 40 of electromagnets or solenoids in an assembly utilized for actuating the print wires in printing operation. The details of construction of the actuating coils 40 of such electromagnets and the printed circuit board 34 are disclosed in U.S. Pat. No. 4,484,170.

Figure 4:
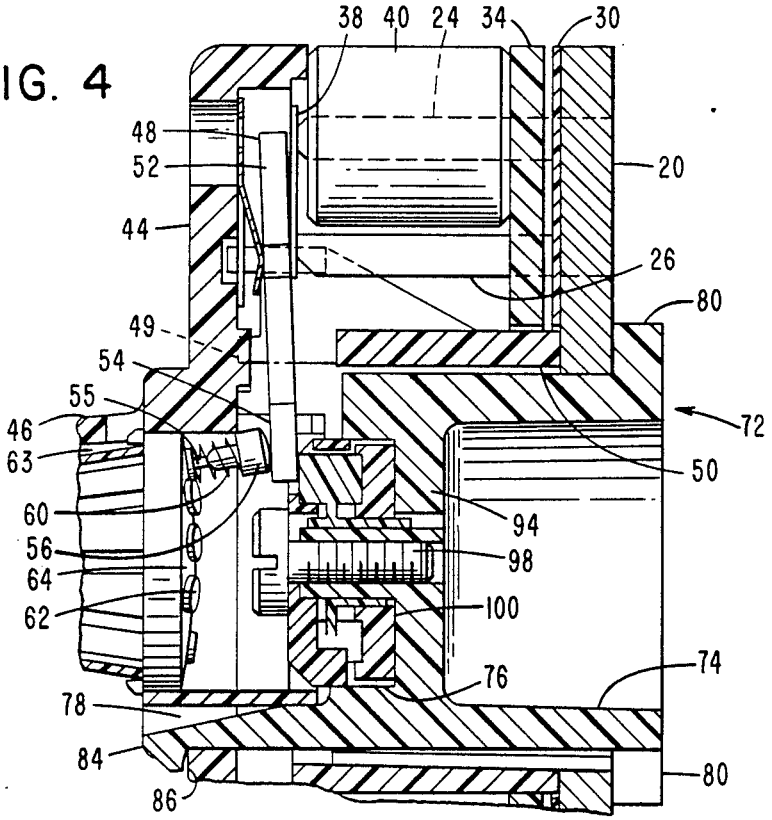
FIG. 4 is an enlarged side elevational view, partly in section, of a portion of the print head and showing the preferred structure of the present invention.

Forward of the residual spacer 38 is the print head housing 42 (FIG. 1) made of plastic and which generally includes a saucer-shaped flange portion 44 and a nose portion 46 integral therewith (see also FIG. 4). The annular flange portion 44 is designed to contain a plurality of print wire engaging members 48 (FIG. 4), herein also known as clappers, which are arranged in a circle and radially positioned to be operably associated with the respective actuating coils 40. The clapper or operating members 48 are considered to be the equivalent of armatures for the actuating coils 40 and are somewhat paddle-shaped in appearance and are positioned or located, at least in partial manner, by means of a notched framework portion 49 on the inner surface of the annular flange portion 44. The framework portion 49 (FIG. 4) comprises a nine-sided circular structure defining precisely spaced notches or slots formed therein for positioning and locating or guiding portions of the clapper members 48, through an intermediate member 50, the particular construction and operation of such intermediate member being fully disclosed in a copending application, Ser. No. 559,993, now U.S. Pat. No. 4,548,521. Each of the clapper members 48 includes a wide portion 52 at the outer end which is the part operably associated with a respective coil 40, and a narrow end portion 54 which engages with a print wire 55 and which is guided between and maintained in place by rearwardly extending posts or fingers formed in a circle radially inwardly of the notched framework 49. Each print wire has a plastic cap 56 (FIG. 4) integrally formed therewith and is biased by a return spring 60 disposed between the plastic cap and an end surface or seat 62 of an inner circular, wire containing portion 64 seated in the nose portion 46 and which spring 60 aids in returning the print wire 55 to the home or non-printing position. The inner portion 64 includes apertures therethrough and is designed as one of the structures to carry and to guide the print wires 55 along their respective paths from the raised surface or seat 62 and across a wire guide bridge, as at 63, and then to a front wire guide tip 66 (FIG. 1) of the nose portion 46. The details of the construction of the means for carrying and guiding the print wires 55 along such respective paths are disclosed in U.S. Pat. No. 4,501,506.

A plurality of apertures (not shown) are arranged in a circle around the housing flange portion 44 and correspond with the positions of the wide end portions 52 of the respective clapper members 48 for use in manually checking operation of those members and also the print wires 55 as to freedom of movement thereof.

Figure 2:
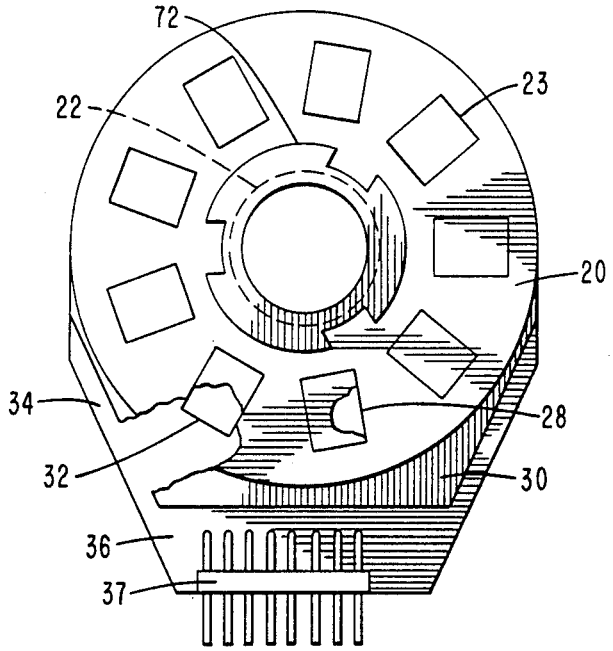
FIG. 2 is a view taken along the line 2—2 of FIG. 1.
Figure 3:
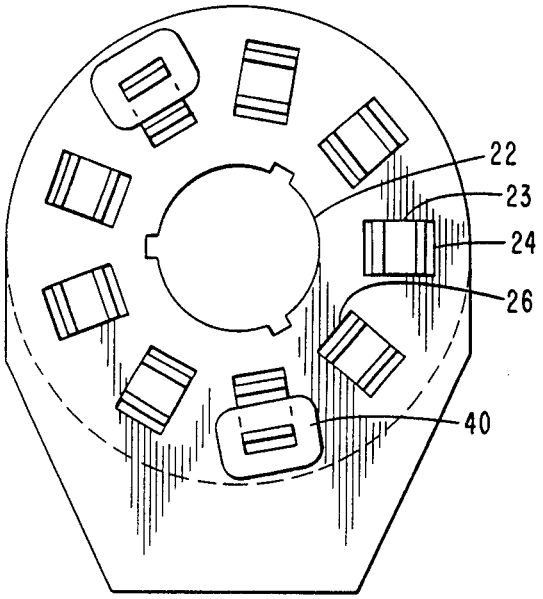
FIG. 3 is a view taken along the line 3—3 of FIG. 1.

It is here noted that FIG. 2 also includes an open-end view of a fastener-backstop member, generally described as 72, and which is described in detail in U.S. Pat. No. 4,502,799. The backplate 20 along with the insulator 30, the printed circuit board 34 and the actuating coils 40 are contained and secured to the housing flange portion 44 (FIG. 1) by the particular construction of the member 72. As fully described in above-mentioned U.S. Pat. No. 4,502,799, the forward or closed end of member 72 serves as a backstop for the clapper members 48 when they are returned from the printing to the home or non-printing position. An assembly contained within the forward end portion of such member 72 provides a dampering seat for the narrow end portions 54 of the clapper members 48 by engagement with one side thereof. The opposite side of each of the narrow end portions 54 of the clapper members 48 engages with the plastic cap 56 (FIG. 4) of the associated print wire 55 and is biased thereagainst by the action of the spring 60 between the spring seat 62 and the plastic cap.

When the actuating coil 40 is energized, the wide end portion 52 (FIG. 4) of the associated clapper member 48 is caused to be pulled in a manner whereby the armature or clapper member is pivoted or rocked in a clockwise direction and the narrow end portion 54 of such clapper member is moved against the cap 56 to cause the print wire 55 to be moved toward the front end 66 of the print head housing 42 (FIG. 1) and to a printing position. Upon deenergizing the coil 40, the clapper 48 is rocked in a counter-clockwise direction by action of the return spring 60 against the cap 56 and such narrow end portion 54 of the clapper member 48 is returned to rest for seating on the central portion of the fastener-backstop member 72.

FIG. 4 is a side view of the fastener-backstop member, generally designated as 72, and which includes a hollow cylindrical portion 74 (see also FIG. 6) with one end portion 76 from which extend three equally-spaced fingers 78. A slotted lip or flange portion 80 (see also FIG. 1) substantially surrounds the opposite end of the cylindrical portion 74. Each of the fingers 78 has a tip portion 84 which includes an angled surface for engaging with and gripping an edge 86 of the housing flange 44 (FIG. 4). The angled surface is designed to accommodate any variation in distance from the back surface of plate 20 to the edge 86 due to part tolerances.

Further described, FIG. 4 is a side view, partly in section, illustrating the arrangement of the parts in making and in teaching the principles of the present invention. The fastener-backstop member 72 is inserted through the opening 22 (FIGS. 2 and 3) in the backplate 20 and the tips 84 of the three fingers 78 thereof are formed to fit through three companion openings (not shown but aligning with openings shown in FIGS. 2 and 3) in the housing flange portion 44 and engage with the outer surface thereof at the edge or point 86. The lip or flange portion 80 engages the backplate 20 around the edge surface of the aperture 22 and thereby fastens and secures the parts together. In this manner, the backplate 20 along with the spacer 30, the printed circuit board 34 and the actuating coils 40 are contained and secured to the housing flange portion 44 by the particular construction of the fastener-backstop member 72.

Figure 5:
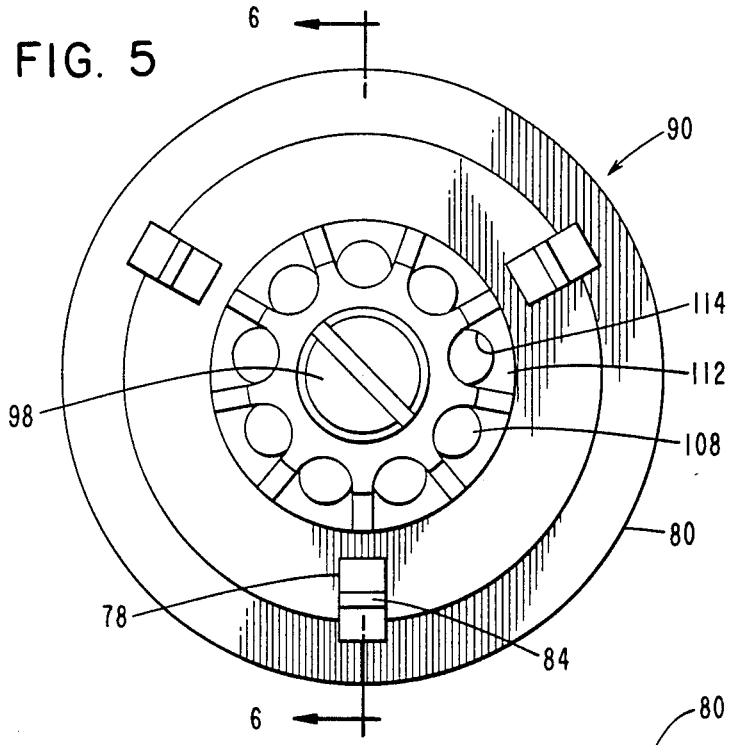
FIG. 5 is a view of the backstop assembly incorporated into the assembly of FIG. 4.

FIG. 5 is a view of a backstop assembly 90 installed in operating position in the print head 18 and looking toward the right in FIG. 4 and showing a central portion thereof but omitting certain parts of the print head for clarity. The assembly 90 includes the fastener-backstop member 72 (shown in section in FIG. 6) with the hollow cylindrical portion 74 and the flange portion 80 disposed at one end and the fingers 78 at the other end. A second hollow cylindrical portion 92 of slightly smaller diameter is provided at the other end with a portion 94 connecting the two cylindrical portions.

Figure 6:
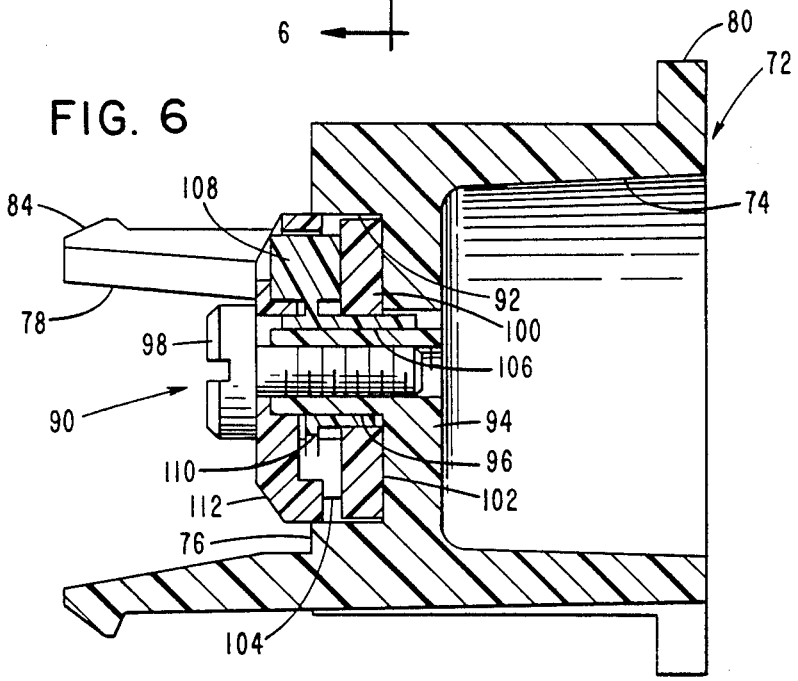
FIG. 6 is a view taken along the line 6—6 of FIG. 5.

The connecting portion 94 has a centrally-positioned post 96 extending as an integral part thereof in the direction of the fingers 78, and such post is internally threaded to receive a screw 98. A damper 100 in the form of a flat washer is placed over the post 96 and seated against one surface 102 of the portion 94 (FIG. 6). A backstop plunger 104 is then positioned over the post 96 with a sleeve portion 106 of the plunger being slidingly fitted over the post and through the aperture of the washer 100. The plunger 104 includes a plurality of individual plunger elements 108 of generally solid cylindrical form and equally spaced to accommodate a total of nine print wires, although a seven wire print head is a preferred arrangement. Each of the plunger elements 108 is connected to the sleeve portion 106 of the plunger 104 by means of a hinge or spring portion 110 as an integral part of the plunger.

A plunger stop 112 having a plurality of apertures 114 (FIG. 5) equally spaced and corresponding to the disposition of the plunger elements 108 is placed in the end of the hollow cylindrical portion 92 and the screw 98 is used to secure the plunger stop 112, the backstop plunger 104 and the damper 100 to the backstop-fastener member 72.

It should be noted that the backplate 20 is made of aluminum, the core members 23 are made of silicon iron and the circuit board 34 is epoxy glass. Further, the clappers or armatures 48 are made of silicon iron and the fastener-backstop member 72 is made of glass fiber reinforced plastic material. The damper is a rubber elastomer, the backstop plunger is made of glass filled nylon, and the plunger stop is made of polycarbonate.

It is thus seen that herein shown and described is a fastener-backstop member that serves the combined functions of securing the several parts of the print head together and of providing a rest or home position dampening assembly for the print wires when they are returned to the non-printing position. The apparatus of the present invention enables the accomplishment of the objects and advantages mentioned above, and while a preferred embodiment has been disclosed herein, variations thereof may occur to those skilled in the art. It is contemplated that all such variations not departing from the spirit and scope of the invention hereof are to be construed in accordance with the following claims.

We claim:

1. A wire matrix print head comprising a housing portion, a plurality of print wires extending through said housing portion and movable from a non-printing position to a printing position, means for actuating the print wires from the non-printing to the printing position, means for supporting the actuating means in position relative to the housing portion to provide an operating arrangement of the print wires, armature means operable associated with the actuating means and with the print wires for operating the print wires from the non-printing to the printing position, means engageable with said supporting means and with said housing portion for securing thereof and including a hollow cylindrical portion at one end of said engageable means, and means including a dampening member coupled with said engageable means and seated in said hollow cylindrical portion and plunger means having a sleeve portion extending through said dampening member and including a plurality of individual elements hinged to said sleeve portion and integral therewith and engaging said dampening member for providing dampening for the print wires upon return from the printing to the non-printing position.

2. The print head of claim 1 wherein the housing portion includes an elongated member having guide means for supporting said print wires therealong.

3. The print head of claim 1 wherein the actuating means comprise electromagnetic elements and said armature means comprise rockable members operably connecting said electromagnetic elements with the print wires.

4. The print head of claim 1 wherein the means for supporting the actuating means includes a circuit board operably connected therewith.

5. The print head of claim 1 wherein the armature means includes an elongated clapper element having one end thereof engageable with a respective print wire and with the engageable means and having the other end thereof engageable with the actuating means.

6. The print head of claim 1 wherein the engageable means includes a member having extensions on one end thereof for connecting with the housing portion and a flange on the other end thereof engaging with the supporting means.

7. The print head of claim 3 wherein the electromagnetic elements are coil wound bobbins supported from a circuit board.

8. The print head of claim 1 including spring means and wherein each print wire includes a head portion continually engageable with the armature means and urged by said spring means toward the nonprinting position.

9. The print head of claim 1 wherein the engageable means includes a cylindrical member having a plurality of fingers on one end thereof for connecting with the housing portion and a circular flange on the other end thereof for engaging the supporting means and securing thereof with the housing portion.

10. In a wire matrix print head having a housing with an elongated portion and an annular portion, a plurality of print wires extending from the annular portion and through the elongated portion to the end thereof, means for actuating the print wires from a non-printing to a printing position, and means adjacent one end of the actuating means for supporting thereof in position for operating the print wires, the improvement comprising means engageable with the supporting means and with the annular housing portion for securing thereof, and dampening means including a resilient dampening member adjacent said engageable means and plunger means having a sleeve portion coupled with said dampening member and extending therethrough and including a plurality of individual elements hinged to said sleeve portion as an integral part thereof and engaging said dampening member for providing seating for the print wires upon return from the printing to the non-printing position.

11. In the print head of claim 10 wherein the actuating means includes a plurality of electromagnetic elements and corresponding armature members operably associated with respective print wires.

12. In the print head of claim 10 wherein the actuating means includes a plurality of electromagnetic elements and corresponding armatures engageable with the print wires and rockable by said electromagnetic elements for causing the print wires to move from the non-printing to the printing position.

13. In the print head of claim 10 wherein the supporting means for the actuating means includes a circuit board operably connected therewith.

14. In the print head of claim 10 wherein the engageable means includes a member having extensions on one end thereof for connecting with the annular housing portion and a flanged portion on the other end thereof engaging with the supporting means and wherein the individual elements are backstops engageable with respective actuating means for providing stop surfaces for the print wires.

15. In a wire matrix print head having a housing with an elongated portion and an annular portion, a plurality of print wires extending from the annular portion and through the elongated portion to the end thereof, means for actuating the print wires from a non-printing to a printing position, and means adjacent one end of the actuating means for supporting thereof in position for operating the print wires, the improvement comprising a fastening member having a flange portion at one end thereof engageable with the supporting means and a body portion having a plurality of fingers at the other end thereof, and means including a dampening member seated in said body portion and plunger means having a sleeve portion coupled with and extending through said dampening member and including a plurality of individual elements hinged to said sleeve portion as an integral part thereof and engaging said dampening member for dampening the print wires, said annular portion being formed to receive the ends of the fingers and to secure the actuating means supporting means to the annular portion in assembled manner.

16. In the print head of claim 15 wherein the fastening member is cylindrically shaped and includes equally-spaced fingers engageable with the annular portion and wherein the individual elements are engageable with respective actuating means for providing stop surfaces for the print wires.

17. In the print head of claim 15 wherein the ends of the fingers define inclined surfaces engageable with an edge of said annular portion for accommodating tolerances in the supporting means and in the annular portion.

18. In the print head of claim 15 wherein the body portion is cylindrically shaped and said other end includes a central portion containing the individual elements positioned to be engageable by the print wire actuating means in the non-printing position.

19. In the print head of claim 15 wherein the fastening member is a cylinder open at said one end and includes an end portion for closing the other end, said end portion defining a recess for containing the individual elements engageable by the print wire actuating means in the non-printing position.

* * * * *